United States Patent [19]

Onda et al.

[11] 4,310,622

[45] Jan. 12, 1982

[54] PHOTOGRAPHIC DEVELOPMENT PROCESS

[75] Inventors: Shinzaburo Onda; Eiichi Okutsu; Isamu Itoh; Hiroyuki Mifune, all of Minami-ashigara, Japan

[73] Assignee: Fuji Photo Film Co., Ltd., Minami-ashigara, Japan

[21] Appl. No.: 174,428

[22] Filed: Aug. 1, 1980

[30] Foreign Application Priority Data

Aug. 3, 1979 [JP] Japan ..... 54-99181

[51] Int. Cl.[3] ..... G03C 5/30

[52] U.S. Cl. ..... 430/445; 430/446; 430/488

[58] Field of Search ..... 430/456, 355, 419, 488, 430/489, 490, 445, 446, 248, 251

[56] References Cited

U.S. PATENT DOCUMENTS

| | | | |
|---|---|---|---|
| 3,335,009 | 8/1967 | Rasch | 430/419 |
| 3,698,900 | 10/1972 | Johnson | 430/445 |
| 4,254,215 | 3/1981 | Kramp et al. | 430/419 |

FOREIGN PATENT DOCUMENTS

| | | | |
|---|---|---|---|
| 160168 | 10/1938 | Fed. Rep. of Germany | 430/445 |
| 1158838 | 12/1963 | Fed. Rep. of Germany | 430/445 |
| 2205873 | 8/1972 | Fed. Rep. of Germany | 430/423 |
| 52-68419 | 6/1977 | Japan | 430/445 |

*Primary Examiner*—Mary F. Downey

*Attorney, Agent, or Firm*—Sughrue, Mion, Zinn, Macpeak and Seas

[57] ABSTRACT

A process is described for developing a black-and-white silver halide photosensitive material comprising treating the material with a developing solution containing a sludge preventing compound represented by the formula (I)

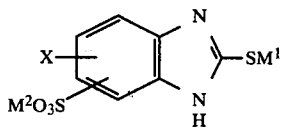

(I)

wherein X represents hydrogen, a hydroxyl group, a lower alkyl group, a lower alkoxy group, a halogen atom, a carboxyl group or a sulfo group, and $M^1$ and $M^2$, which may be the same or different, each represents hydrogen, an alkali metal atom, or an ammonium group.

8 Claims, No Drawings

PHOTOGRAPHIC DEVELOPMENT PROCESS

BACKGROUND OF THE INVENTION

1. Field of the Invention

The present invention relates to a process for developing silver halide black-and-white photographic sensitive materials and, particularly, to a development process which does not generate silver sludges even if a developing solution which contains sulfite in a high concentration or a silver halide solvent is used.

2. Description of the Prior Art

When processing image-wise exposed photographic materials comprising at least one silver halide layer, development is generally carried out in a presence of, for example, hydroquinone, catechol, aminophenol, phenylenediamine, pyrazolidone, reductone or hydroxylamine derivatives. The development is generally carried out in an alkaline medium, and the developing solution generally contains additives such as sulfites for stabilization, pH buffer materials, anti-fogging agents, and so forth. Particularly, in order to increase the stability of the developing solution, it is important to add sulfite in a high concentration. Furthermore, in order to obtain a special effect, the development of photographic materials is sometimes carried out in a presence of a silver halide solvent. For example, it has been known to add, as the silver halide solvent, divalent sulfur compounds, for example, mercapto compounds, thioethers or thioamides, thiocyanates, sulfites in a high concentration or thiosulfates. Developers containing the silver halide solvent have been used both as micrograin developers or mean grain developers (see *Modern Photographic Processing,* by Grant Haist, published by Wiley-Interscience Co., 1979, pp. 225–229). Another important embodiment of using the silver halide solvent is a one-bath development-fixing solution, which has been described in *Monobath Manual,* by G. Haist (published by Morgan Co., 1960).

The developing solution containing the silver halide solvent or the sulfite in a high concentration dissolves a comparatively large amount of silver salt from the silver salt layer of the photographic materials. The silver salt dissolved in the developing solution is then reduced by a developing agent to become finely-divided metallic silver, by which sludges are formed in said solution. Particularly, when developing by means of a conveyor type automatic development apparatus using a developing solution containing a large amount of silver halide solvent, deposition of sludges causes serious problems because a large amount of silver salt dissolves. Particularly, when processing at a high temperature, extreme deposition of sludges occurs. These sludges deposit as lumps on various parts of the conveyor type automatic development apparatus used for development, such as on rolls, belts, etc., to contaminate the surface of films or damage the films, by which quality of finished photographs deteriorates. Accordingly, it is important to prevent the silver contamination of films, particularly in photographic sensitive materials for printing.

Examples of known sludge preventing agents used for the above-described purpose include 2-mercapto-1,3,4-thiadiazoles (British Patent 940,169), 2-mercapto-1,3,4-oxadiazoles or 1-phenyl-5-mercaptotetrazole (U.S. Pat. No. 3,173,789), DL-6,8-dithiooctanoic acid (U.S. Pat. No. 3,318,701), o-mercaptobenzoic acid (British Pat. No. 1,144,481), aliphatic mercaptocarboxylic acids (U.S. Pat No. 3,628,955), L-thiazolidine-4-carboxylic acid (*J. Photogr. Sci.,* Vol. 13, p. 233 (1965)), divalent sulfur compounds (Japanese Patent Application (OPI) No. 36029/77 (the term "OPI" as used herein refers to a "published unexamined Japanese patent application"), 2-mercaptobenzoxazole and 2-mercaptobenzimidazole (*Photogr. Sci. Eng.,* Vol. 20, p 220 (1976)), and so forth.

However, none of these compounds are completely satisfactory as sludge preventing agents in the photographic developing solutions, and particularly in developing solutions containing a compound which has a dissolving function with respect to silver halide, such as sulfite in a high concentration (e.g., in an amount of 13 g or more of sulfite per liter of developing solution, as mentioned hereinafter). Many mercapto compounds rapidly lose their sludge preventing function because of (1) air oxidation of the mercapto compounds and (2) reactions of disulfide compounds, which are formed by oxidation of the mercapto compounds, with sulfite ions. When a large amount of silver salt is dissolved, insoluble silver salts result, which contaminate the films, though the degree of contamination depends upon the amount present. Furthermore, the addition of a large amount of mercapto compounds sometimes inhibits the rate of the development. Moreover, some such compounds give off an unpleasant smell.

Further, since the above-described compounds have low water-solubility, it is difficult to add them in an amount necessary to prevent deposition of sludges.

SUMMARY OF THE INVENTION

Accordingly, a first object of this invention is to provide a process for preventing the generation of sludges in developing solutions for silver halide photographic materials.

A second object of the invention is to provide a process for obtaining photographic images having excellent finished quality when a black-and-white silver halide photosensitive material is processed by means of an automatic development apparatus.

A third object of the invention is to provide a process for processing black-and-white silver halide photosensitive materials using a developing solution containing a sludge-preventing compound that has excellent solubility and stability in the developing solution.

The above-described objects have been attained by processing black-and-white silver halide photosensitive materials using a developing solution containing a sludge preventing compound represented by the formula (I)

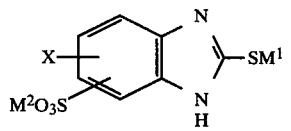

(I)

In formula (I), X represents hydrogen, a hydroxyl group, a lower alkyl group, a lower alkoxy group, a halogen atom, a carboxyl group or a sulfo group, and $M^1$ and $M^2$, which may be the same or different, each represents hydrogen, an alkali metal atom, or an ammonium group.

DETAILED DESCRIPTION OF THE INVENTION

The compound represented by the formula (I) in this invention may be present in a tautomeric form thereof, as shown by formula (II) below, that is, when $M^1$ is a hydrogen atom

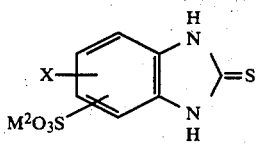

(II)

X and $M^2$ in formula (II) have the same meaning as that in formula (I).

In this invention, the sludge preventing effect is particularly great when a compound represented by the formula (I) is added to a developing solution containing a comparatively large amount of sulfite ion, thiosulfate ion, thiocyanate ion or another compound having a dissolving function for silver halide such as thioether compound or thioamide compound. Further, a developing solution according to the present invention is particularly effective in preventing deterioration of the finished quality of photographs which can be caused by contamination or damage of the surface of films, when it is used in the case of processing the photosensitive materials by means of a roll conveyor type or belt conveyor type automatic development apparatus.

The lower alkyl group and the lower alkoxy group represented by X in formulae (I) or (II) refer groups having from 1 to 5 carbon atoms. Preferred alkyl and alkoxy groups are those having from 1 to 3 carbon atoms.

Examples of preferred compounds represented by the formula (I) are as follows.

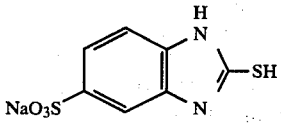

Compound (I-1)

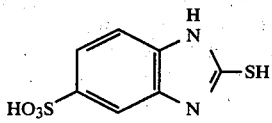

Compound (I-2)

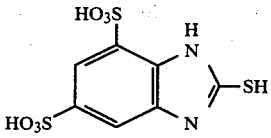

Compound (I-3)

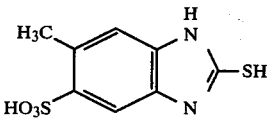

Compound (I-4)

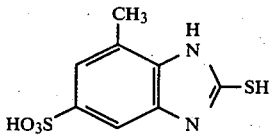

Compound (I-5)

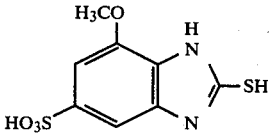

Compound (I-6)

-continued

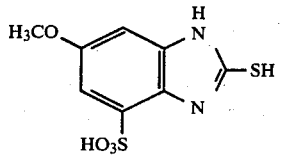

Compound (I-7)

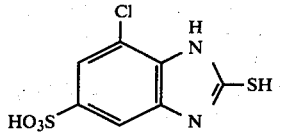

Compound (I-8)

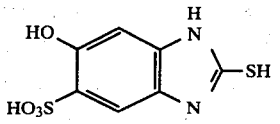

Compound (I-9)

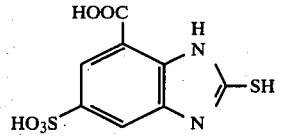

Compound (I-10)

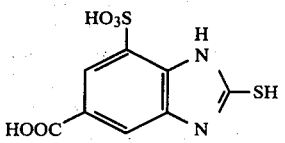

Compound (I-11)

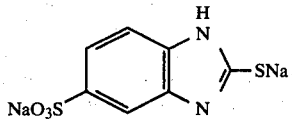

Compound (I-12)

The above-described compounds can be synthesized by a reaction of o-phenylenediamine compounds represented by the formula (III) with carbon disulfide according to the process described in *The Chemistry of Heterocyclic Compounds, Imidazole and Its Derivatives,* Part 1, p. 384, by K. Hofmann, published by Interscience Co. (1953).

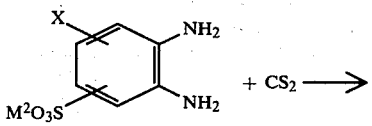

(III)

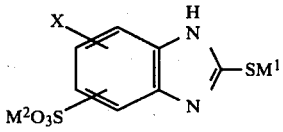

(I)

The amount of the compound represented by formula (I) in the developing solution depends upon many factors, for example, pH and solubility to silver of the treating solution, treating temperature, properties and silver content of the photographic material to be processed, degree of fatigue of the treating solution and others.

In common use, the compound represented by formula (I) is added in an amount of from about 0.005 to about 5 g, and preferably from about 0.01 to about 1.0 g, per liter of developing solution. However, the amount of the compound represented by formula (I) is not limited to the above-mentioned range and may be more than the range or may be lower than the range, for example, it is preferred to add the compound of formula (I) in an amount of from about 1 to about 20 g per liter of the developing solution in the case of a strongly alkaline one-bath development-fixing solution which is used at a high temperature.

In a developing solution according to the present invention, it is possible to use conventional black-and-white photographic developing agents, such as, for example, hydroquinone, alkylhydroquinones (for example, t-butylhydroquinone, methylhydroquinone or dimethylhydroquinone), catechol, pyrazole, chlorohydroquinone, dichlorohydroquinone, alkoxyhydroquinone (for example, methoxy or ethoxyhydroquinone), aminophenol developing agents (for example, N-methyl-p-aminophenol or 2,4-diaminophenol), ascorbic acid developing agents, N-methyl-p-aminophenol sulfate, pyrazolones (for example, 4-aminopyrazolone), and 3-pyrazolidone developing agents (for example, 1-phenyl-3-pyrazolidone, 1-phenyl-4,4-dimethyl-3-pyrazolidone, 1-phenyl-5-methyl-3-pyrazolidone, 1-phenyl-4-methyl-3-pyrazolidone, 1,5-diphenyl-3-pyrazolidone, 1-p-tolyl-3-pyrazolidone, 1-phenyl-2-acetyl-4,4-dimethyl-3-pyrazolidone, 1-p-hydroxyphenyl-4,4-dimethyl-3-pyrazolidone, 1-(2-benzothiazolyl)-3-pyrazolidone or 3-acetoxy-1-phenyl-3-pyrazolidone), etc., which may be used alone or as a combination thereof.

3-Pyrazolidone developing agents are particularly useful, all or a part of which may be added to the photographic material, because 3-pyrazolidone developing agents can be added directly to an emulsion layer itself or to a layer adjacent to the emulsion layer. However, in a developing solution for high contrast photographic sensitive materials containing sulfite in a high concentration, it is generally desired that the pyrazolidone developing agents be added to the aqueous developing solution in an amount sufficient to effectively carry out rapid processing.

Combinations of hydroquinone and 3-pyrazolidones or hydroquinone and aminophenols are particularly preferred for the rapid processing at a high temperature.

The developing solution is generally alkaline when it is used, but the kind and amount of alkali agents to be added are not particularly limited. In order to prevent oxidation of the developing solution, it is possible to use conventionally used alkali metal sulfites, such as sodium sulfite, potassium sulfite or potassium metabisulfite. When the compound represented by the formula (I) is used for a developing solution containing free sulfite ions in an amount of 13 g or more, and particularly for amounts of 20 g or more, per liter of the developing solution, the sludge preventing effect is excellent. Furthermore if a developing solution containing a water-soluble silver halide solvent such as a mercapto compound, thioether, thioamide or thiocyanate is used, the sludge preventing effect is also excellent.

When the concentration of thiocyanate or thiosulfate is from 0.2 to 10 g/l in a conventional type developing solution, the sludge preventing effect of the compounds according to this invention is excellent. Moreover, in a one-bath development fixing solution wherein the concentration of thiosulfate is generally from 10 to 200 g/l, the sludge preventing effect of the present invention is excellent.

A developing solution containing a compound which has a function of dissolving silver halide, such as sulfite or thiosulfate, etc., dissolves part or all of the non-developed silver halide in the photosensitive material. The dissolved silver salt is then reduced by the developing agent to form finely-divided metallic silver, by which sludges are formed in the solution. According to the development process of the present invention, formation of sludges is prevented, but said process may result in some tendency towards fogging of the films. Therefore, it is preferred to use an anti-fogging agent together with the compound represented by formula (I). As the anti-fogging agent, there are, for example, benzotriazoles (for example, 5-methylbenzotriazole), imidazoles (for example, 5-nitroimidazole), benzimidazoles having low water solubility and being not substituted by a sulfo group (for example, 2-mercaptobenzimidazole) and mercaptotetrazole, and so forth. Further, the developing solution is capable of containing other components, such as water-soluble acids (for example, acetic acid or boric acid), alkalis (for example, sodium carbonate or sodium hydroxide), pH buffer agents such as salts, and development controlling agents such as alkali halides (for example, potassium bromide, etc.). Certain kinds of alkali agents not only make the developing solution alkaline, but also function as a pH buffer agent and a development controlling agent. The developing solution may contain, further, antioxidants such as ascorbic acid, primary or secondary alkanolamines (for example, diethanolamine, etc.), water softeners such as ethylenediaminetetraacetic acid or nitrilotiracetic acid, etc., polyalkylene oxides, amino compounds, and organic solvents such as triethylene glycol, dimethylformamide, methyl alcohol or cellosolve, etc.

In the present invention, it is sufficient that such components are contained in the developing solution at the time of using. The components before incorporation in the processing solution may have any state, for example, a mixture, condensed state, solution, emulsion or suspension of the solid components, and so forth. For example, components for the developing solution may be divided into several portions to make developing solutions in the same or different state, or they may be in a state of a previously mixed powder or a liquid mixture.

A mixture of ingredients previously prepared can be dissolved in, or diluted with, water, if desired, to make a processing solution ready for use.

When carrying out development according to the present invention, the temperature of the developing solution can generally be about room temperature, namely, from about 20° to 30° C. However, in case of a high temperature rapid processing, the processing may be carried out at a temperature of from about 30° to 60° C.

The photosensitive materials processed according to the process of the present invention may not be limited. The silver halide in the photosensitive layer can be silver chloride, silver chlorobromide, silver chloroiodobromide, silver bromide or silver iodobromide, etc. The effect of the present invention is excellent when a photosensitive material comprising a silver halide emulsion which does not contain silver iodide or has a low silver iodide content (for example, 2 mol% or less) is used. Further, the photosensitive materials used in the present invention may be either of the negative type or direct positive type.

Silver sludges generated in the developing solution easily adhere to rolls or belts in the developing apparatus, and the silver sludges adhering to the rolls or belts easily contaminate the photosensitive materials. Accordingly, the process of the present invention is particularly effective when used in case of processing by means of an automatic developing apparatus.

Examples of such automatic developing apparatus include, for example, counter roller type apparatus (for example, Pakorol Super G24-2 by PAKO Co., or FG-14L and FG-24SQ by Fuji Photo Film Co.), zigzag roller type apparatus (for example, Kodalith Processor by Eastman Kodak Co.), belt conveyor type apparatus (for example, LD-241D by Log-E-tronics Co.) and others (for example, Cronalith 24L by Du Pont Co.). These automatic developing apparatus are referred to the description of *Graphic Arts Monthly*, Vol. 8, p. 60 (1970).

The present invention is illustrated in greater detail by reference to the following examples.

EXAMPLE 1

Developing Solution (A), and Developing Solution (B), having the following compositions, were prepared.

Developing Solution (A)

| | |
|---|---|
| Sodium sulfite | 67 g |
| Hydroquinone | 23 g |
| 1-Phenyl-3-pyrazolidone | 0.4 g |
| Potassium hydroxide | 11 g |
| Sodium carbonate (1 hydrate) | 11 g |
| Potassium bromide | 3.0 g |
| Compound (I-1) | 288 mg |
| Water to make | pH 10.65 |

Developing Solution (B)

A developing solution having the same composition as in Developing Solution (A), except that Compound (I-1) was not added, was prepared.

The following experiment was carried out for each of Developing Solution (A) and Developing Solution (B).

22 l of the developing solution was placed in a roll conveyor type automatic development apparatus (FG-24SQ, produced by Fuji Photo Film Co.). After a black-and-white photographic film (silver content: 4 g/m$^2$) having a silver chlorobromide (silver chloride: 50 mol%) emulsion layer on a polyethylene terephthalate base was image-wise exposed to light, it was introduced into the above-described development apparatus to carry out development. The developing temperature was 38° C. and the developing time was 20 seconds. The developing solution was automatically supplemented at the rate of 100 ml per development of each full size sheet (i.e., 20 inches×24 inches).

100 full size sheets of film were developed over 5 hours per day, and this processing operation was continued for 1 week. In the case of Developing Solution (B), which did not contain the sludge preventing agent, the developing solution, which was colorless and transparent initially, became cloudy when the initial 100 sheets of films were developed, and deposition of silver sludge was observed.

Stripe silver contamination began to generate on the film. During processing for 1 week, this contamination increased further. Serious muddiness and deposition of silver sludge were observed in the developing solution and serious silver contamination was observed on rolls of the automatic development apparatus. Stripe silver contamination on the film significantly increased as a further number of sheets were processed.

Further, damage which was supposed to be cuased by contact with sludges adhering to the roll was observed on the surface of the film.

On the other hand, in the case of Developing Solution (A) which contained the sludge preventing agent, the developing solution, which was colorless and transparent initially, was quite transparent after development processing was carried out for 1 week, and no silver sludge was observed. Furthermore, silver contamination or damage was not observed on the surface of the film.

EXAMPLE 2

Each developing solution was prepared by adding $1\times10^{-3}$ mol of the following compound to 1 liter of Developing Solution (B) in Example 1. The following experiment was carried out for each of the developing solutions just after preparation, and after preservation for 1 week at 40° C. in a sealed polyethylene container containing air.

2 liters of the developing solution was placed in a roll conveyor type improved automatic development apparatus, Fuji X-ray processor RE-3 (produced by Fuji Photo Film Co.). After a black-and-white photographic film (silver content: 4 g/m$^2$) having a silver chlorobromide (silver chloride: 50 mol%) emulsion layer on a polyethylene terephthalate base was image-wise exposed to light, it was introduced into the above-described development apparatus. The developing temperature was 38° C. and the developing time was 20 seconds. The developing solution was supplemented at the rate of 25 ml per development of each sheet having a size of 35.4 cm×21.5 cm. After developing 20 sheets of the film over 5 hours, a non-exposed black-and-white film strip of 1.5 cm×12 cm was developed by the automatic development apparatus in order to determine correctly the stripe silver contamination on the surface of the film. The results indicated in Table 1 were obtained using developing solutions containing the compounds as indicated.

TABLE 1

| Experiment No. | Compound | Developing Solution Just after Preparation | Developing Solution Preserved at 40° C. for 1 Week |
|---|---|---|---|
| 2-1 (comparative example | 2-Mercaptobenzimidazole 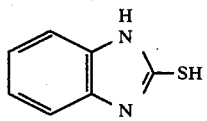 | Developing solution became seriously cloudy and sludges were deposited after 1 day. Muddiness was observed on the film strip. | Developing solution became seriously cloudy and sludges were deposited after 1 day. Muddiness was observed on the film strip. |

TABLE 1-continued

| Experiment No. | Compound | Developing Solution Just after Preparation | Developing Solution Preserved at 40° C. for 1 Week |
|---|---|---|---|
| 2-2 (comparative example) | 2-Mercaptobenzimidazole-5-carboxylic acid 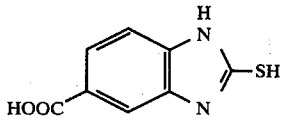 | Serious muddiness was generated and reddish brown sludges were deposited. Stripe silver contamination by the roll was observed on the film strip. | Serious muddiness was generated and reddish brown sludges were deposited. Stripe silver contamination by the roll was observed on the film strip. |
| 2-3 (comparative example) | 2-Mercaptobenzoxazole-5-sulfonic acid 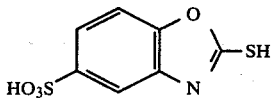 | Muddiness was generated and reddish brown sludges were deposited. Stripe silver contamination by the roll was observed on the film strip. | Muddiness was generated and reddish brown sludges were deposited. Stripe silver contamination by the roll was observed on the film strip. |
| 2-4 (comparative example) | 1-Phenyl-5-mercaptotetrazole 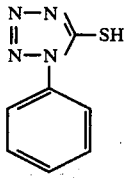 | Serious muddiness was generated and a large amount of sludges were deposited. Serious silver contamination was observed on the film strip. | Serious muddiness was generated and a large amount of sludges were deposited. Serious silver contamination was observed on the film strip. |
| 2-5 (comparative example) | $H_3C-CH(SH)-COOH$ | Colorless transparent. No contamination was observed on the film strip. | Muddiness. Reddish brown sludges were deposited. Stripe silver contamination by the roll was observed on the film strip. |
| 2-6 (present invention) | 2-Mercaptobenzimidazole-5-sulfonic acid 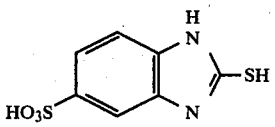 | Colorless transparent. No contamination was observed, on the film strip. | Colorless transparent. No contamination was observed on the film strip. |
| 2-7 (present invention) | 2-Mercaptobenzimidazole-5-disulfonic acid 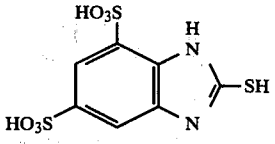 | Colorless transparent. No contamination was observed, on the film strip. | Colorless transparent. No contamination was observed on the film strip. |

While the invention has been described in detail and with reference to specific embodiments thereof, it will be apparent to one skilled in the art that various changes and modifications can be made therein without departing from the spirit and scope thereof.

What is claimed is:

1. A process for developing a black-and-white silver halide photosensitive material comprising the steps of: imagewise exposing the material; and treating the material with a developing solution containing a sludge preventing compound in an amount of about 0.01 to 1.0 g per liter of developing solution represented by the formula (I)

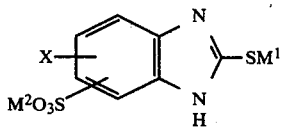

(I)

wherein X represents hydrogen, a hydroxyl group, a lower alkyl group having 1 to 5 carbon atoms, a lower alkoxy group having 1 to 5 carbon atoms, a halogen atom, a carboxyl group or a sulfo group, and $M^1$ and $M^2$, which may be the same or different, each represents hydrogen, an alkali metal atom, or an ammonium group.

2. A process for developing a black-and-white silver halide photosensitive material as in claim 1, wherein X is a lower alkyl group or a lower alkoxy group containing from 1 to 3 carbon atoms.

3. A process for developing a black-and-white silver halide photosensitive material as in claim 1, wherein the compound according to formula (I) is selected from the group consisting of

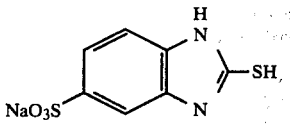

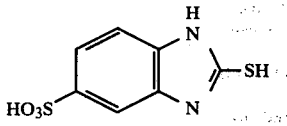

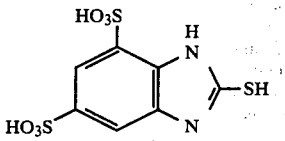

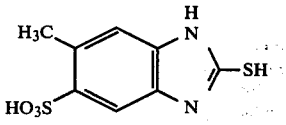

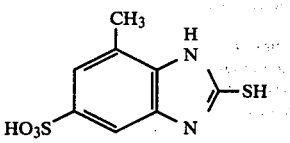

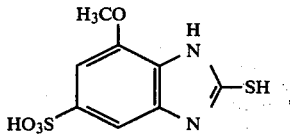

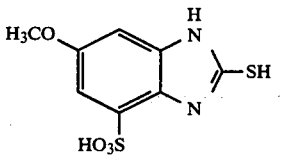

-continued

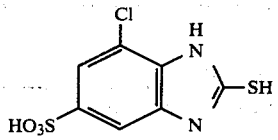

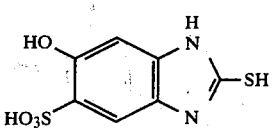

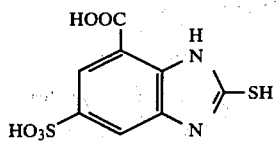

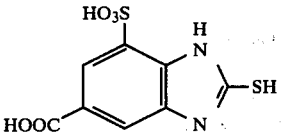

and

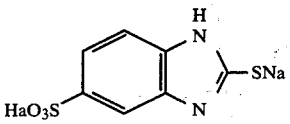

4. A process for developing a black-and-white silver halide photosensitive material as in claim 1, 2, or 3 using a strongly alkaline one-bath development-fixing solution at a high temperature wherein the concentration of sludge preventing compound is from 1 to 20 g per liter of the developing solution.

5. A process for developing a black-and-white silver halide photosensitive material as in claim 1, 2, or 3, wherein the developing solution additionally comprises an anti-fogging agent.

6. A process for developing a black-and-white silver halide photosensitive material as in claim 1, wherein the developing solution additionally comprises an anti-fogging agent.

7. A process for developing a black-and-white silver halide photosensitive material as in claim 2, wherein the developing solution additionally comprises an anti-fogging agent.

8. A process for developing a black-and-white silver halide photosensitive material as in claim 4, wherein the developing solution additionally comprises an anti-fogging agent.

* * * * *